US006874780B2

(12) United States Patent
Rebeaud

(10) Patent No.: US 6,874,780 B2
(45) Date of Patent: Apr. 5, 2005

(54) DEVICE FOR CONTROLLING THE MEANS DELIVERING SHEETS TO A MACHINE

(75) Inventor: Jean-Claude Rebeaud, Le Mont-sur-Lausanne (CH)

(73) Assignee: BOBST S.A. (CH)

( * ) Notice: Subject to any disclaimer, the term of this patent is extended or adjusted under 35 U.S.C. 154(b) by 0 days.

(21) Appl. No.: 10/668,477

(22) Filed: Sep. 22, 2003

(65) Prior Publication Data

US 2004/0061275 A1 Apr. 1, 2004

Related U.S. Application Data

(63) Continuation of application No. 09/855,447, filed on May 15, 2001, now abandoned.

(30) Foreign Application Priority Data

May 16, 2000 (CH) ..... 2000 0963/00

(51) Int. Cl.[7] ..... B65H 1/08

(52) U.S. Cl. ..... 271/154; 271/155; 414/796.7; 414/926

(58) Field of Search ..... 271/107, 30.1, 271/31, 152, 153, 154, 155, 157–159; 414/796.7, 924, 926

(56) References Cited

U.S. PATENT DOCUMENTS 4,021,710 A * 5/1977 Fichte et al. ..... 318/39
4,610,444 A * 9/1986 Lang et al. ..... 271/12
4,832,329 A * 5/1989 Rodi et al. ..... 271/155
5,295,678 A * 3/1994 Lindner et al. ..... 271/152
5,556,252 A * 9/1996 Kuster ..... 414/796.7

* cited by examiner

*Primary Examiner*—Donald P. Walsh
*Assistant Examiner*—Joseph C Rodriguez
(74) *Attorney, Agent, or Firm*—Ostrolenk, Faber, Gerb & Soffen, LLP

(57) ABSTRACT

A device for controlling delivery of sheets from a stack includes a lift for a stack of sheets. A sheet inserter removes sheets from the top of the stack to move them. A detector detects the front top level of the stack and measures the extent of variations in the level of the stack. A computer receives a measurement from the detector and acts on a first electric motor for the lift to raise the stack. A source of information connected to the computer relates to the supply frequency in real time and to the nominal thickness of the sheets. The computer output is connecting to a sheet supply frequency varying device for controlling the first motor to the lift. The computer is programmed so that the signal at its output is characteristic of the difference between the measured level of the stack and the calculated level thereof. An auxiliary supply device may support and raise the stack, based on the computer program, independently of the lift.

9 Claims, 2 Drawing Sheets

DEVICE FOR CONTROLLING THE MEANS DELIVERING SHEETS TO A MACHINE

CROSS-REFERENCE TO RELATED APPLICATIONS

This application is a Continuation of U.S. patent application Ser. No. 09/855,447 filed May 15, 2001 now abandoned.

BACKGROUND OF THE INVENTION

The invention relates to a device for controlling delivery of sheets from a stack to a machine for processing them.

The operation of successively taking the top sheet from a stack of sheets to form a layer of sheets for insertion into a printing or cutting machine is well-known and numerous existing devices serve this purpose. In the case of a sheet-by-sheet supply of solid fiber board or corrugated board, flatness is a frequent problem, since the top surface of the stack may vary considerably in level. This is because the thickness of a cardboard sheet may vary in dependence on a number of external factors such as the ambient humidity or the storage conditions. This provides a difference in height between the front and rear of the stack and also between the center and edges thereof.

It has already been proposed to obviate this disadvantage by means of a device described in CH 651 807, comprising a mechanism for lifting the stack, a sheet-inserting means comprising a gripping element, means for detecting the top level of the stack connected to a computer acting on an electric motor of the stack-lifting mechanism and means for raising the stack in dependence on the top level. When the front level detector cannot see the stack of sheets, a command pulse for raising the stack is sent to the driving motor, which sends a pulse driving the stack-lifting mechanism. Depending on the thickness of the stack of sheets, the duration of the pulse is varied to obtain a variable rise step, so as to bring the top surface of the stack to the same level after the departure of each sheet from the stack.

A device of this kind considerably improves the accuracy of the top level of the stack, more particularly of the front vertical surface. Nonetheless, the disadvantage of raising the stack of sheets by pulses is that the least offset between successive pulses may result in a variation in the step or pitch of the resulting layer of sheets. If the step tolerance exceeds a certain amount, the machine processing the layer of sheets stops and has t be restarted, resulting in substantial loss of production.

SUMMARY OF THE INVENTION

To this end, the invention relates to a device for controlling the means delivering sheets from a stack to a machine for processing them. A device for controlling delivery of sheets from a stack includes a lifting mechanism for a stack of sheets. A sheet inserter removes sheets from the top of the stack to move them. A detector detects the front top level of the stack. A computer is connected to the detector. The computer acts on an electric motor for the stack lifting mechanism and the stack is raised. The detector of the front level of the stack measures the extent of variations in the level of the stack. A source of information connected to the computer relates to the supply frequency in real time and to the nominal thickness of the sheets. The computer output is connecting to a frequency varying device for controlling the motor to the stack raising mechanism. The computer is programmed so that the signal at its output is characteristic of the difference between the measured level of the stack and the calculated level thereof.

The accompanying drawings, diagrammatically and by way of example, illustrate an embodiment of the control device according to the invention.

DESCRIPTION OF A PREFERRED EMBODIMENT

Figure 1:
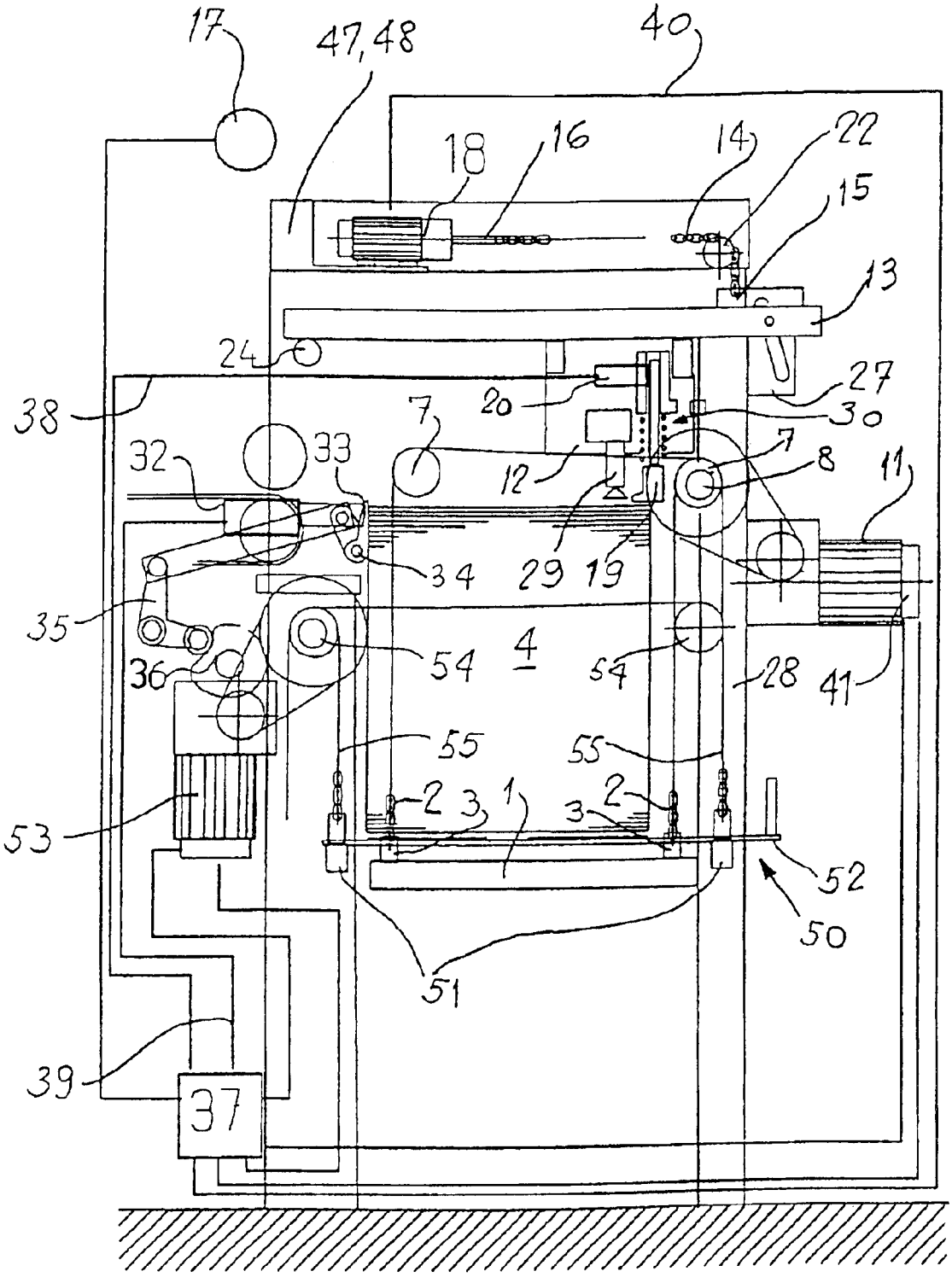
FIG. 1 is a sectional view of a sheet supply station.

FIG. 1 shows a supply station of the kind described in CH 651 807, to which reference should be made for further details. It comprises a stack lift comprising a lifting grid 1 suspended on chains 2. One end of each chain 2 is attached to the lifting grid 1 via at least two, and preferably four, lugs 3 placed on either side of the sheet-supplying stack 4. The other end of each chain 2 is connected to an attachment member through which a screw extends. Each chain 2 passes around a chain wheel 7 mounted on shafts 8. A device vertically drives the lifting grid 1 via the chains 2. The device can comprise the attachment (not shown) in its motion along the screw. The screw is held by two bearings (not shown) and driven by a geared motor 11 equipped with a coder 41. Of course, use can be made of any geared motor device capable of rotating the shaft 8 secured to the chain wheels 7.

The insertion station also comprises a suction group 12 fixed to a chassis 13 suspended from the end of at least one or in the present case at least two chains 14 via lugs 15. The other ends of the chains 14 are fixed to the output shaft of a linear motor 18, where the chains 14 pass around chain wheels 22 mounted on a transverse shaft 23. One end of the chassis 13 rests in slidable manner on a cross-member 24 whereas the other end is provided with a guide device mounted in holders 27 fixed to each lateral upright 28 of the frames 47, 48 of the supply station. This arrangement ensures that the position of the suction group 12 does not change relative to the rear edge of the stack of sheets 4 when it is raised or lowered by the action of the motor 18. The suction group 12 comprises a number of suckers 29 (to simplify the drawings, only one has been shown) and a first detecting means 30 which will be described in further detail hereinafter. The suction group 12 is described only in order to show how sheets are supplied to the machine; this known suction group 12 is not part of the invention and will not be described in detail here.

The first detecting means 30, which comprises a cabriole foot 19 and a scanning cell 20, is placed near the rear top part of the stack of sheets 4 along a theoretical axis corresponding to the theoretical central axis of the stack of sheets 4. A second detecting means 32 is placed opposite the front top part of the stack of sheets 4 along the central axis of the stack. The second detecting means 32 preferably comprises a fixed linear camera disposed in the vertical direction of the stack of sheets 4, so as to supply an analog signal depending on the measured level.

A retractable front abutment is mounted so as to be pivotable around an axis 34 near the top level of the front surface of the stack of sheets 4. The front abutment 33 is pivoted by a lever 35 controlled by a cam 36 actuated by the device driving the insertion station supplied by sheets from the pile 4. The abutment 33 has a window (not shown) centered along the central axis of the stack of sheets 4, giving the detector 32 a constant view of the stop level of the stack 4.

The first detecting means 30 is electrically connected to one of the circuits of a computer 37 by a cable 38, whereas the second detecting means 32 is connected to a second circuit of the said computer 37 by a cable 39. When the computer 37 receives a signal from the first detecting means 30, it transmits positive or negative information for transmission by a cable 40 to the motor 18 controlling the vertical motion of the suction group 12.

Figure 2:
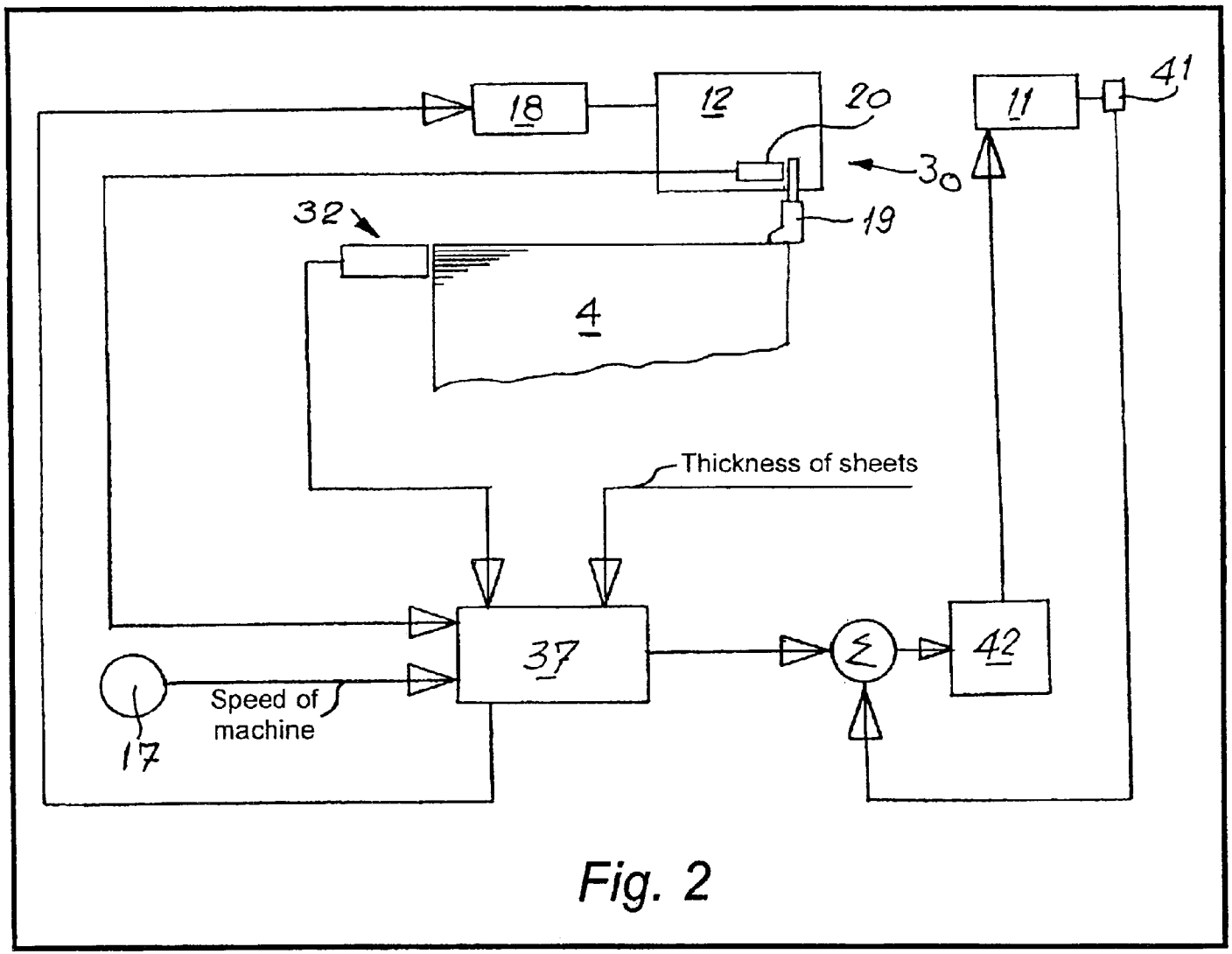
FIG. 2 is a block diagram of the control means of the mechanism for raising the stack for supplying sheets.

As illustrated by the block diagram in FIG. 2, information other than that supplied by the second detector 32 is supplied to the computer circuit 37 in order to control the speed of the geared motor 11. The information relates to the speed of the machine, given by the values transmitted by a pulse generator 17 indicating the frequency at which the suction group 12 raises the sheets from the stack 4. The thickness of the cardboard sheets constitutes the other information introduced into the computer 37. These two items constitute the data for determining the theoretical speed at which the geared motor 11 should raise the stack of sheets 4. This speed, calculated on the basis of the said data, is the set speed of the geared motor 11. The analog signal supplied to the calculator by the second detector 32 enables it in real time to evaluate the difference between the top level of the stack measured by the second detector 32 and the reference top level of the said stack. The comparison between these two levels is used to form a speed signal at the computer output, which is compared with the speed in real time of the geared motor 11 supplied by a coder 41 associated with the motor. The result of the comparison between these two speed signals is used to increase or decrease the supply frequency of the motor, via a frequency varying means 42 connected to the motor 11. The motor 11 thus continuously raises the stack of sheets 4 at a speed constantly adapted to the real level of the stack compared with the reference level.

The insertion station may also comprise an auxiliary supply device 50, commonly called non-stop (NS), for changing a stack without interrupting the flow of sheets. The auxiliary supply device 50 comprises a frame 51 for positioning bars 52 for holding the stack when the grid 1 lifting the main stack has reached a level requiring reloading with a new stack of sheets. Accordingly the bars 52 are inserted under the main stack so as to form an auxiliary grid which holds the main stack and enables the grid 1 to be lowered to a bottom position for loading the new stack.

The non-stop device generally comprises a drive having a mechanism similar to that for raising the grid 1. Inter alia it comprises a geared motor 53 for driving chain wheels 54 around which chains 55 pass and vertically move the frame 51. The geared motor 53 is also connected to the computer 37. When the sheets are supplied by the suction group 12 from the auxiliary supply device 50, the lift regulating means used for the grid 1 are used for the auxiliary supply device 50.

What is claimed is:

1. A device for controlling delivery of sheets from a stack to a machine for further processing, the stack of sheets having a leading face and a trailing face relative to the machine, the device comprising:

a lift operative to raise the stack of sheets;

an electric motor operable only in a continuous mode at a variable speed connected to operate the lift;

a motor controller for the motor;

a vertically movable sheet feeder including a gripping mechanism operative to grip the sheet at the top of the stack for delivery to the machine;

a drive mechanism operative to raise and lower the sheet feeder;

a first detector located near the uppermost position which can be assumed by the top of the stack, and in an operative relationship to the leading face of the stack, the first detector being operative to generate an output signal representative of the vertical position of the top of the stack; and a computer operative to control the drive mechanism for the sheet feeder; and responsive to the output signal from the first detector, a signal representing the rate at which sheets are fed to the machine by the sheet feeder, and a signal representing the thickness of the sheets to generate a signal for the motor controller representing the variable motor speed.

2. The device of claim 1, wherein the first detector comprises a linear camera disposed along the stack for sensing the top level of the stack.

3. A device according to claim 1, wherein the motor controller includes:

a variable frequency drive for the motor, and a speed control feedback circuit comprised of:

a sensor that provides an output signal representative of the actual speed of the motor; and a comparison circuit that provides a control input for the variable frequency drive representative of the difference between the set speed and the actual motor speed.

4. A device according to claim 1, wherein the computer is operative in real time to generate the variable motor speed signal on the basis of the difference between actual vertical position of the top of the stack as measured by the first detector and a reference vertical position for the top of the stack determined from the rate at which sheets are fed to the machine by the sheet feeder, and a preset value representing the thickness of the sheets.

5. A device according to claim 1, wherein the first detector is located substantially equidistantly from side faces of the stack which connect the leading and trailing faces.

6. A device according to claim 1, wherein the sheet feeder includes a second detector located near the uppermost position which can be assumed by the top of the stack, and in operative relationship to the trailing face of the stack, the second detector is operative to generate an second output signal representative of the vertical position of the top of the stack; and the computer is responsive to the second output signal to generate an output for controlling the drive mechanism for the sheet feeder.

7. A device according to claim 6, wherein the second detector is located substantially equidistantly from side faces of the stack which connect the leading and trailing faces.

8. A device according to claim 7, wherein the first detector is located substantially equidistantly from the side faces of the stack.

9. The device of claim 1, further comprising:

an auxiliary supply device operable for holding the stack when the lift does not hold the stack; and a second motor operative to raise and lower the auxiliary supply device, the computer being operative to utilize the same programming that controls the first electric motor for the lift, to also control the second motor, and thereby to control the rate at which the auxiliary supply device raises the stack independently of the lift.

* * * * *